US008402975B2

(12) United States Patent
Venegas, Jr.

(10) Patent No.: US 8,402,975 B2
(45) Date of Patent: Mar. 26, 2013

(54) POST COVER SLEEVE WITH CIGARETTE RECEPTACLE

(76) Inventor: Frank Venegas, Jr., Brighton, MI (US)

( * ) Notice: Subject to any disclaimer, the term of this patent is extended or adjusted under 35 U.S.C. 154(b) by 808 days.

(21) Appl. No.: 11/224,535

(22) Filed: Sep. 12, 2005

(65) Prior Publication Data

US 2006/0213530 A1 Sep. 28, 2006

Related U.S. Application Data

(60) Provisional application No. 60/608,702, filed on Sep. 10, 2004.

(51) Int. Cl.
*A24D 1/12* (2006.01)
*A24F 13/02* (2006.01)

(52) U.S. Cl. ..... 131/175; 400/607; 52/301; 52/835; 248/219.2; 248/309.1

(58) Field of Classification Search ..... None
See application file for complete search history.

(56) References Cited

U.S. PATENT DOCUMENTS

| | | | | | |
|---|---|---|---|---|---|
| 1,637,172 | A * | 7/1927 | Burress | 224/276 |
| 1,792,765 | A * | 2/1931 | Schehl | 131/257 |
| 2,375,243 | A * | 5/1945 | Pinkett | 131/239 |
| 2,646,050 | A * | 7/1953 | Webster | 131/174 |
| 4,881,654 | A * | 11/1989 | Stazo et al. | 2/209.13 |
| 5,263,391 | A * | 11/1993 | Naylor | 81/176.2 |
| 5,299,883 | A * | 4/1994 | Arth, Jr. | 404/10 |
| 5,323,583 | A | 6/1994 | Venegas, Jr. | 52/727 |
| D374,941 | S | 10/1996 | Venegas, Jr. | D25/126 |
| D426,898 | S | 6/2000 | Venegas, Jr. | D25/126 |
| D464,585 | S | 10/2002 | Nesbit | D11/157 |
| 2003/0230684 | A1 * | 12/2003 | Clary | 248/219.2 |

* cited by examiner

*Primary Examiner* — Richard Crispino
*Assistant Examiner* — Phu Nguyen
(74) *Attorney, Agent, or Firm* — Gifford, Krass, Sprinkle, Anderson & Citkowski, P.C.

(57) ABSTRACT

A cover for posts, bollards, and the like, includes an integral or attached cigarette receptacle. A sleeve for covering a post includes an open bottom, a closed top, and an outer sidewall, and a cigarette receptacle attached to the sidewall of the sleeve. The sleeve is preferably cylindrical. The sleeve has a height in the range of two to 10 feet and an inner diameter in the range of 2 to 10 inches. The sleeve may be plastic, and may feature a hemispherically shaped top. The cigarette receptacle may be temporarily or permanently attached to the sidewall of the sleeve. The cigarette receptacle preferably includes a lower portion and an upper, removable cap. The cigarette receptacle may be plastic with an inner, non-flammable liner, or may be composed of metal. The cigarette receptacle preferably includes a small hole into which cigarettes are placed.

6 Claims, 1 Drawing Sheet

POST COVER SLEEVE WITH CIGARETTE RECEPTACLE

REFERENCE TO RELATED APPLICATION

This application claims priority to U.S. Provisional Patent Application Ser. No. 60/608,702, filed Sep. 10, 2004, the entire content of which is incorporated herein by reference.

FIELD OF THE INVENTION

The present invention relates generally to post covers, bollards, and the like, and more particularly, to a protective cover for a stanchion or post that includes a cigarette receptacle.

BACKGROUND OF THE INVENTION

Stanchions or posts are commonly found in industrial and commercial settings to protect a building structure or fixed equipment from vehicular traffic. Guard posts or protective stanchions are commonly found in public parking lots and the like to protect drive-up windows and equipment, telephone booths, store entrances, and so forth.

Existing guard posts and protective stanchions often comprise a steel post set in the ground or pavement with a portion of the post projecting a desired amount above the pavement surface, commonly on the order of about four feet or so. To enhance the durability of such a steel pipe stanchion, one may fill the steel pipe with concrete. This both closes the interior of the pipe to environmental deterioration and enhances the structural integrity and impact absorbing qualities of the stanchion.

Further, existing stanchions are typically painted to preserve the exterior of the stanchion and resist deterioration by rusting or the like. Protective stanchions are also painted to provide a high visibility color.

However, steps to enhance the durability of a protective stanchion such as painting are typically labor-intensive and require repetitive maintenance to repair chipped paint, worn surfaces, or discoloration over time.

To address this maintenance problem, U.S. Pat. No. 5,323,583 provides a protective sleeve for upright posts and stanchions. The sleeve comprises an elongated body extending between two opposing ends and an interior cavity extending along the sleeve and through at least one of the two opposing ends. Further, the interior cavity has a cross-sectional shape adapted for slip fit engagement with the post. The post is inserted into the interior cavity and the sleeve force fit over the post. According to a preferred embodiment, the sleeve includes a decorative feature in the form of a smooth hemispherical top on the closed opposing end, as shown and claimed in U.S. Pat. No. D464,585. A textured version is shown and claimed in U.S. Pat. No. 426,898.

Post sleeves have also been combined with other features. For example, U.S. Pat. No. D374,941 is directed to an ornamental design for a combined stanchion with sleeve and signage. The need remains, however, for a post cover with additional functional and/or decorative features.

SUMMARY OF THE INVENTION

This invention resides in post covers, bollards, and the like, and in particular, to a protective cover for a stanchion or post that includes an integral or attached cigarette receptacle.

The preferred embodiment comprises a sleeve for covering a post, the sleeve including an open bottom, a closed top, and an outer sidewall, and a cigarette receptacle attached to the sidewall of the sleeve. The sleeve is preferably cylindrical.

The sleeve has a height in the range of two to 10 feet and an inner diameter in the range of 2 to 10 inches. The sleeve may be plastic, and may feature a hemispherically shaped top.

The cigarette receptacle may be temporarily or permanently attached to the sidewall of the sleeve. The cigarette receptacle preferably includes a lower portion and an upper, removable cap.

The cigarette receptacle may be plastic with an inner, non-flammable liner, or may be composed of metal. The cigarette receptacle preferably includes a small hole into which cigarettes are placed.

DETAILED DESCRIPTION OF THE INVENTION

This invention relates to sleeves used to cover posts, stanchions, and the like. These are often found out-of-doors, to protect vehicles, and to provide other applications, features of this type often being referred to as "bollards." In distinction with previous designs, the sleeves according to this invention include a decorative and functional cigarette receptacle.

Figure 1:
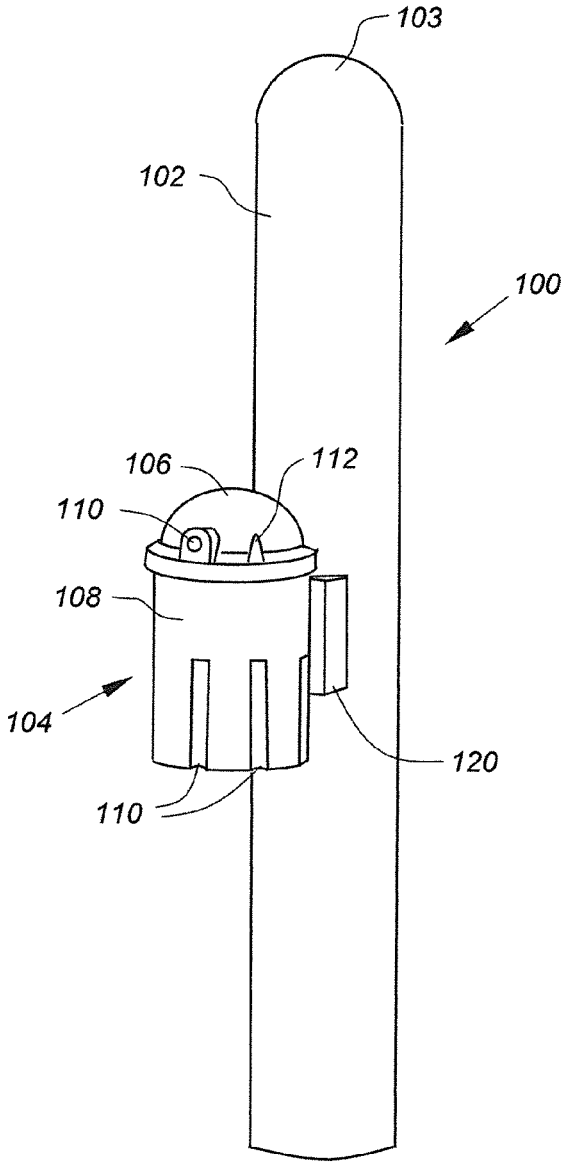
FIG. 1 is a drawing that illustrates a preferred embodiment of the invention.

FIG. 1 illustrates generally at 100 a preferred embodiment of the invention. The assembly comprises a sleeve 102 to which there is attached at least one cigarette receptacle 104. The sleeve 102 includes a generally cylindrical lower portion, with an open bottom and a closed top. Although a smooth, hemispherically shaped top 103 is depicted, other top configurations may be used, as shown and described in U.S. patent application Ser. No. 09/597,318, the content being incorporated herein by reference.

The sleeve 102 is preferably a polymeric material, such as a structural plastic, including polyethylenes, polycarbonates, PVC, ABS, and the like. The invention is not limited in this regard. Nor is the invention limited by the way in which the sleeve 102 is manufactured, as rotational and blow-molding processes may be used. The lower cylindrical portion may also be extruded, with the upper cap portion 103 being attached by gluing, welding, or the like.

The sleeve 102 is physically configured to fit over posts of the kind normally found in parking areas, loading areas, building entrances, and so forth. Accordingly, the height of sleeve 102 is in the range of two to ten feet, or thereabouts, preferably in one-foot or finer increments. The inside diameter of the sleeve is also configured to fit over posts, and accordingly is in the range of two to ten inches, again, preferably in one-inch increments for different applications. In addition to the composition of the sleeve itself, additives to color the sleeve, or to protect the sleeve from UV radiation, may optionally be added.

The cigarette receptacle 104 is preferably attached to the side of the sleeve through fasteners, gluing, welding or the like. An integral molding process may also be used, at least to attach the lower portion 108 of the receptacle 104 to the side of the sleeve 102. Although a single cigarette receptacle is shown, multiple receptacles may be attached peripherally around the sleeve, including receptacles at different heights.

The receptacle 104 includes a lower portion 108 which, as mentioned, is attached to the sleeve 102, in an upper portion 106, which may be removed to empty the contents. Although the lower portion 108 and cap 106 are preferably made of plastic, a non-flammable liner is provided within, to ensure that melting or fires do not take place. For example, a steel or metal can may be placed inside the lower portion 108 below the cigarette entry hole 110. Alternatively, the entire receptacle 104 may be composed of a metal or other nonflammable material, without the need for a liner. Although decorative grooves 110 and 112 are shown, they are not necessary to the function of the apparatus. To space the receptacle 104 apart from the side of the sleeve 102, a spacer 120 is used.

Figure 2:
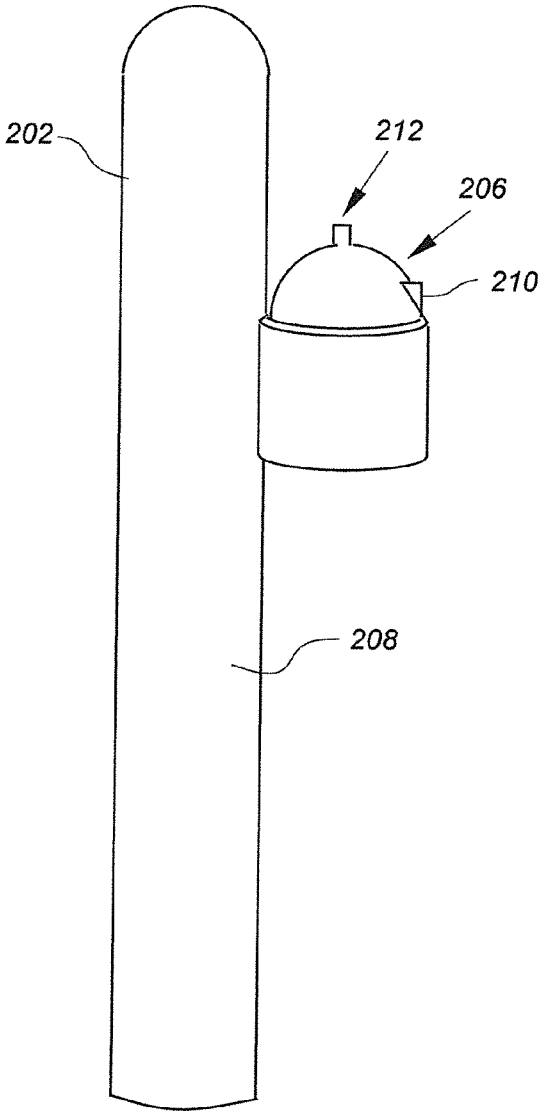
FIG. 2 is a drawing that shows an alternative embodiment of the invention.

FIG. 2 illustrates an alternative embodiment of the invention, including a different, decorative receptacle having a smooth lower portion 208, and a differently shaped cap 206. As with the embodiment of FIG. 1, multiple cigarette entry points 210, 212 may be used. In this case, a spacer such as 120 is not used, but rather, the lower portion 208 is connected directly to the side of the sleeve 202. The sleeve 202 is otherwise the same in construction as that described with reference to FIG. 1.

I claim:

1. A cigarette receptacle assembly, comprising:

a generally cylindrical, plastic sleeve for covering a post, the sleeve including an open bottom, a closed top, and an outer sidewall; and a plastic cigarette receptacle attached to the sleeve, the cigarette receptacle including a lower portion and an upper, removable cap and a small cigarette entry hole; and wherein the plastic cigarette receptacle includes an inner, non-flammable liner.

2. The assembly of claim 1, wherein the sleeve has a height in the range of two to 10 feet.

3. The assembly of claim 1, wherein the sleeve has an inner diameter in the range of 2 to 10 inches.

4. The assembly of claim 1, wherein the sleeve has a hemispherically shaped top.

5. The assembly of claim 1, wherein the cigarette receptacle is temporarily or permanently attached to the sidewall of the sleeve.

6. The assembly of claim 1, wherein the inner, non-flammable liner is metal.

* * * * *